United States Patent [19]

Lee

[11] 4,281,495

[45] Aug. 4, 1981

[54] INSULATED STRUCTURE

[76] Inventor: Yun S. Lee, 475 Atkinson Dr. #608, Honolulu, Hi. 96814

[21] Appl. No.: 94,114

[22] Filed: Nov. 14, 1979

[51] Int. Cl.[3] ..... E04C 1/10; E04C 1/30; E04B 1/40

[52] U.S. Cl. ..... 52/584; 52/127; 52/262; 52/264; 52/285; 52/580

[58] Field of Search ..... 52/127, 285, 264, 584, 52/580, 262

[56] References Cited

U.S. PATENT DOCUMENTS

| | | | |
|---|---|---|---|
| 1,157,469 | 10/1915 | Von Philp | 52/584 |
| 2,887,740 | 5/1959 | Potchen | 52/584 X |
| 2,896,271 | 7/1959 | Kloote et al. . | |
| 3,621,624 | 11/1971 | Gustafson | 52/127 X |
| 3,665,664 | 5/1972 | Watson | 52/211 |
| 4,051,641 | 10/1977 | Elliott | 52/584 X |
| 4,070,848 | 1/1978 | Lingle | 52/584 X |
| 4,125,301 | 11/1978 | Phan | 52/309.9 |

FOREIGN PATENT DOCUMENTS

| | | | |
|---|---|---|---|
| 494530 | 7/1953 | Canada | 52/127 |
| 806008 | 12/1958 | United Kingdom . | |

*Primary Examiner*—Alfred C. Perham
*Attorney, Agent, or Firm*—Lane, Aitken, Kice & Kananen

[57] ABSTRACT

An insulated building for enclosing a refrigerated space is assembled from a plurality of standard-sized modules with each module connected to its adjacent module through a joint interface that includes confronting sealing surfaces that are formed parallel to, perpendicular to, and obliquely to the plane of the modules and connected together by a threaded fastener that extends at an oblique angle to the plane of the modules so that each pair of confronting surfaces are placed under a positive sealing force to provide both a moisture-proof and structurally rigid joint.

6 Claims, 6 Drawing Figures

INSULATED STRUCTURE

BACKGROUND OF THE INVENTION

The present invention relates to an insulated building for enclosing an insulated area and, more particularly, to an insulated building assembled from a plurality of insulated modules that are connected together through moisture-proof joints to provide a moisture impervious structure.

Many refrigerated buildings and other structures are typically constructed from pre-fabricated standard-sized wall modules that are interconnected or joined with one another and to roof and floor modules to form the completed structure. One problem associated with modular refrigerated buildings is that a large number of joints are created each of which must be sealed from the outside environment to prevent moisture-laden ambient air from passing through the joints into the interior building. As is well known, the seepage of such moisture-laden air through the joints causes the moisture to condense upon or freeze on the interior walls of the structure and the material or merchandise being stored within the refrigerated area.

In prior modular designs, variously configured joint interfaces have been used to effect the connection between the modules. These joint interfaces have includes simple butt-type configurations as well as more sophisticated stepped, keyed, or scarfed configurations. In addition, a mastic-type combined sealant/adhesive is commonly placed on or between the various confronting surfaces of the joint to assist in effecting the moisture proof seal. While the joints of this type are generally satisfactory, the modules of most refrigerated buildings are generally fabricated from materials having a comparatively high thermal coefficient of expansion (e.g., foamed plastics) and are subject to comparatively large thermal gradients that place the joint interface under thermally induced stresses which can cause deterioration of the joint integrity with time.

In view of the above, it is an overall object of the present invention, among others, to provide an insulated structure for enclosing a refrigerated area that is fabricated from a plurality of standard-sized modules with the module structurally connected together through moisture-proof joint interfaces.

It is another object of the present invention to provide a modular, insulated structure for enclosing a refrigerated area in which the modules are interconnected through a joint interface that includes a plurality of sealing surfaces arranged at various inclinations relative to one another to provide a moisture-proof seal.

It is still another object of the present invention to provide a modular insulated structure in which the modules are interconnected together through a joint interface having a plurality of confronting sealing surfaces and maintained in their connected relationship by threaded fasteners inclined relative to the various sealing surfaces under a positive sealing force to effect sealing and to structurally connect the modules.

An insulated structure for enclosing a refrigerated space in accordance with the present invention includes a plurality of wall modules that are interconnected to roof and floor modules through moisture-proof, structurally rigid joint interfaces. The joint surface on the peripheral edge of each wall module includes a first sealing surface that meets with the exterior surface of the module and is aligned generally perpendicular to the plane of the module, a second sealing surface that meets with the first sealing surface and is generally parallel to the plane of the module, a third sealing surface that meets with the second sealing surface and is generally obliquely aligned relative to the plane of the module, and a fourth sealing surface that meets with the third sealing surface and the interior surface of the module and that is aligned generally perpendicular to the plane of the module such that both the first and fourth sealing surfaces are generally parallel to and spaced apart from one another. When the modules are interconnected with one another, the various sealing surfaces confront one another to permit a threaded fastener to extend through a bore formed generally normal to the third sealing surfaces of one of the modules to engage a complementary threaded fastener in the next adjacent module so that the threaded fastener, when tightened, places each pair of confronting sealing surfaces under a positive sealing force or pressure to provide both a moisture-proof and a mechanically rigid joint.

An insulated structure for enclosing a refrigerated space in accordance with the present invention is easily and quickly erected with threaded fasteners used to quickly mechanically connect the modules and provide a positive sealing pressure or force for the various parallel, oblique, and perpendicular confronting sealing surfaces to provide a moisture-proof, structurally rigid joint interface.

DESCRIPTION OF THE FIGURES

The above description, as well as the objects, features, and advantages of the present invention will be more fully appreciated by reference to the following detailed description of a presently preferred but nonetheless illustrative embodiment in accordance with the present invention when taken in conjunction with the accompanying drawings wherein.

DESCRIPTION OF THE PREFERRED EMBODIMENT

Figure 1:
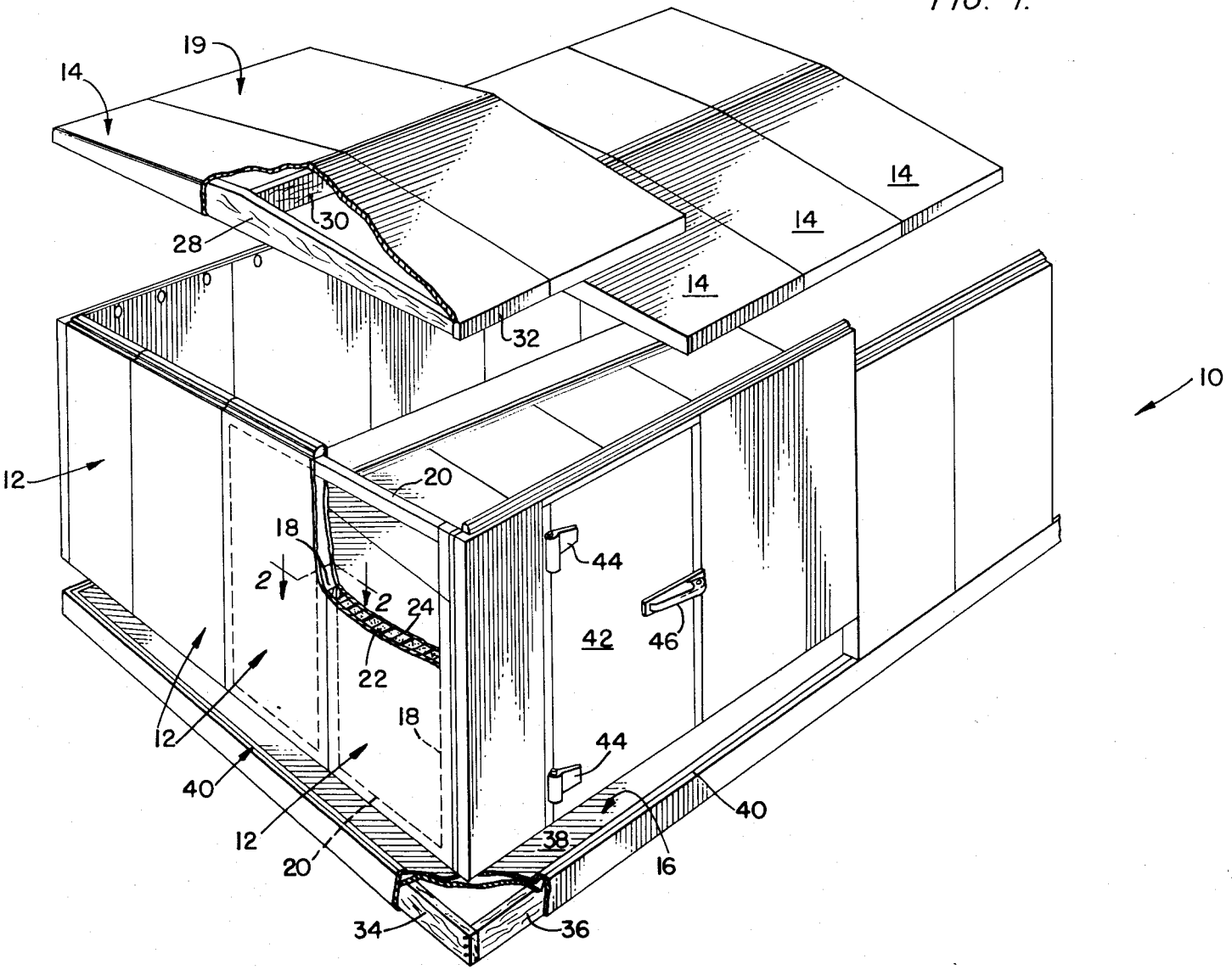
FIG. 1 is a partial exploded perspective view of an exemplary insulated structure assembled from a plurality of wall, roof and floor modules having joint interfaces in accordance with the present invention in which selected parts are broken away for reasons of clarity.

A pre-fabricated refrigerated building or structure assembled from modules in accordance with the present invention is shown in exploded perspective in FIG. 1 and generally referred to therein by the reference character 10. The refrigerated structure is assembled from a plurality of wall modules, each identified generally by the reference character 12, a plurality of roof modules 14, and a base-floor 16 with the various modules interconnected by the joint interfaces described below.

Each of the wall modules 12 includes a frame (shown in broken-line illustration and full-line illustration in FIG. 1) that includes two vertically aligned, spaced apart studs or side member 18 rigidly connected to two horizontally aligned, spaced apart top and bottom members 20. In the preferred embodiment, the vertical and horizontal members 18 and 20 are formed from construction-grade wood. An exterior sheathing panel 22 covers and is secured to the exterior side of each module 12, and an interior sheathing panel 24 covers and is secured to the interior side of each module. Various types of impervious sheathing material may be used, e.g., galvanized sheet metal and rigid sheet plastics. The marginal edges of the sheathing on the interior and exterior sides of the modules 12 are bent out of the plane of the sheath and over the edge of the joint interface as explained more fully below. The frame, the exterior sheath 22, and the interior sheath 24 define an interior space that is filled with insulating material 26 such as closed and/or open cell urethane foams, fiber glass, and the like. The insulating material 26 may be either formed in place during fabrication of the modules or injected into the interior space after the module is fabricated.

Each of the roof modules 14 include spaced apart truss pieces 28 connected by a ridge member 30 at the central portion of the roof module 14 and forward and rearward connecting pieces 32. The roof modules 14, as shown in FIG. 1, are adapted to span the full width of the building 10 and be connected to the top of the wall modules 12 through the joint interface described below. The interior space of each roof module 14 is filled with the insulating material 26 (not shown).

The base-floor 16 includes lateral joists 34 that are spaced apart and connected to forward and rearward members 36 and topped with a flooring material such as plywood 38 which, if preferred, can be faced with the same sheathing material used to sheath the modules 12. The interior spaces defined between the various joists 34 are filled with the insulating material 26 (not shown). A plurality of joint sills 40 that define part of the joint interface between the base-floor 16 and the bottom of the wall modules 12 are provided on the upwardly facing peripheral edge of the base floor 16.

The building 10, as shown in FIG. 1, and can be provided with one or more entry and exits doors 42 that are secured to the adjacent module 12 by hinges 44 and latched in place by a handle-type latch 46.

Each of the modules described above has a joint configuration along its peripheral mating edge that facilitates connection to its adjacent wall module 12, roof module 14, and the base-floor 16. The joint interface provides an air-tight and moisture-proof seal between the various modules that permits the modules to be structurally connected together so that threaded fasteners that effect mechanical connection between the modules also provides sealing force or stress on the various confronting surfaces of the joint interface to provide the moisture-proof seal. A typical joint interface for connecting two adjacent, side-by-side wall modules 12 is shown in exploded perspective in FIG. 2 and its assembled relationship in FIG. 3. This joint interface is taken along a horizontal plane 2—2 shown in FIG. 1 passing through the joint interface of two adjacent wall modules 12.

Figure 2:
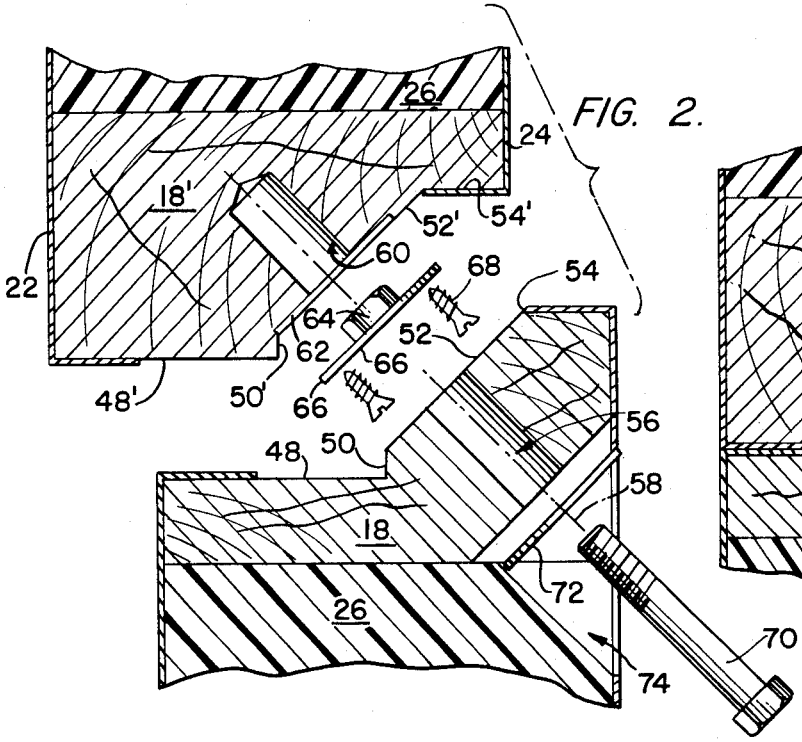
FIG. 2 is an exploded view, in cross section, of a typical joint interface between two adjacent wall modules.
Figure 3:
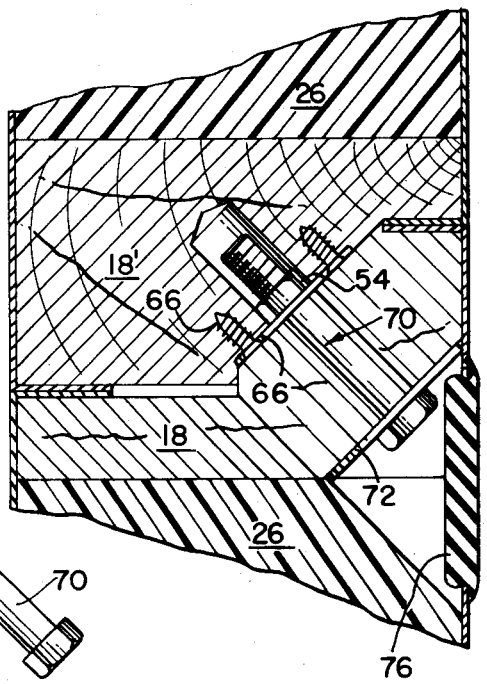
FIG. 3 is a cross-sectional view of FIG. 2 with the modules shown in their assembled state to provide a moisture-proof seal.

In FIG. 2, the reference characters for the upper side member 18 are identified by a prime symbol (′) while the corresponding reference characters for the lower side member are unprimed. As shown therein, the side member 18 includes a first sealing surface 48 that is formed the length of the side member 18 and is generally perpendicular to the major plane of the module 12. The sealing surface 48 meets with or joins with a second sealing surface 50 that extends substantially parallel to the major plane of the module and is substantially perpendicular to its adjacent sealing surface 48. The second sealing surface 50 meets with or joins with a third sealing surface 52 that is obliquely aligned relative to the major plane of the module. A fourth sealing surface 54 joins with or meets with the oblique sealing surface 52 and the interior side of the module 12. The marginal edges of the exterior and interior sheathing panels 22 and 24, as mentioned above, are bent over and overlie, respectively, the sealing surfaces 48 and 54. The various sealing surfaces 48′, 50′, 52′, and 54′ of the side member 18′ of the adjacent wall module 12′ are formed substantially identically to those of the side member 18 of the wall module 12 with the various sealing surfaces designed to confront one another when the modules are in their assembled form. In the preferred embodiment, the various sealing surfaces may be formed by a milling operation.

The wall modules 12 and 12′ are connected together along their respective lengths by cooperating threaded fasteners placed at predetermined intervals along the side members. As shown in FIG. 2, the side member 18 is provided with a clearance bore 56 that is aligned substantially perpendicular or normal to the oblique sealing surface 52 along an axis 58. The side member 18 is provided with a pilot hole 60 that is also aligned substantially perpendicular to its oblique sealing surface 54′ and aligned along the fastener axis 58. A shallow counterbore or recess 62 surrounds the pilot hole 60. A nut 64 is secured to (as by spot welding) to a flat washer 66 and is positioned in the pilot hole 60 with the flat washer 66 received within the recess 62. The nut 64 and the washer 66 are held in place by wood screws 68 passing through clearance holes (not shown) formed through the washer 66. A bolt 70 extends through the bore 56 with a flat washer 72 positioned between the head of the bolt and the side of the member 18.

When the two side-by-side modules 12 and 12′ are interconnected, the bolt 70 engages and extends through the nut 64 to draw the various confronting sealing surfaces 48—48′, 50—50′, 52—52′, and 54—54′ together and place the various sealing surfaces under a positive sealing force to effect a tortuous, moisture-proof seal. The interior sheath 24 at each threaded fastener 70 location on each adjacent module is provided with a semi-circular cut-out which, when it mates with the semi-circular cut-out on the interior sheath 24 of the next adjacent wall module, forms a circular opening 74 through which the bolt 70 and washer 72 are inserted. After the connection between the side-by-side modules is effected, a sealing plug 76 is used to seal the opening 74.

Figure 6:
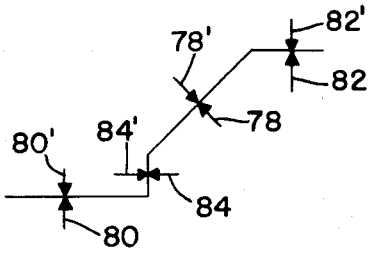
FIG. 6 is a force vector diagram showing the application of the sealing forces to the various confronting sealing surfaces of the joint interfaces shown in FIGS. 2–5 when the threaded connecting fastener is tightened.

As shown in the force vector diagram of FIG. 6, the oblique alignment of the threaded fastener 70 along the axis 58 in combination with the various parallel, perpendicular, and obliquely aligned confronting sealing surfaces permits an effective moisture-proof mechanical seal to be established between the wall modules. The threaded fastener 70 directly applies primary sealing forces 78 and 78' to the obliquely aligned sealing surfaces 52—52' to place them under direct sealing compression. A portion of the forces 78 and 78' are resolved by the inclined-surface geometry of the joint interface into forces 80—80' and 82—82' which place the parallel sealing surfaces 48—48' and 54—54' under compression. Likewise, a portion of the primary sealing forces 78—78' is resolved by the geometry of the interface into compression forces 84—84' which place the sealing surfaces 50—50' in compression. Since, in the preferred embodiment, the marginal edges of the exterior and interior sheaths 22 and 24 of each module overlie the sealing surfaces 48 and 54, the marginal edges are likewise placed under compression to assist in providing a sealed connection and mechanically retain the sheaths 22 and 26 in place on the wall modules 12.

Figure 4:
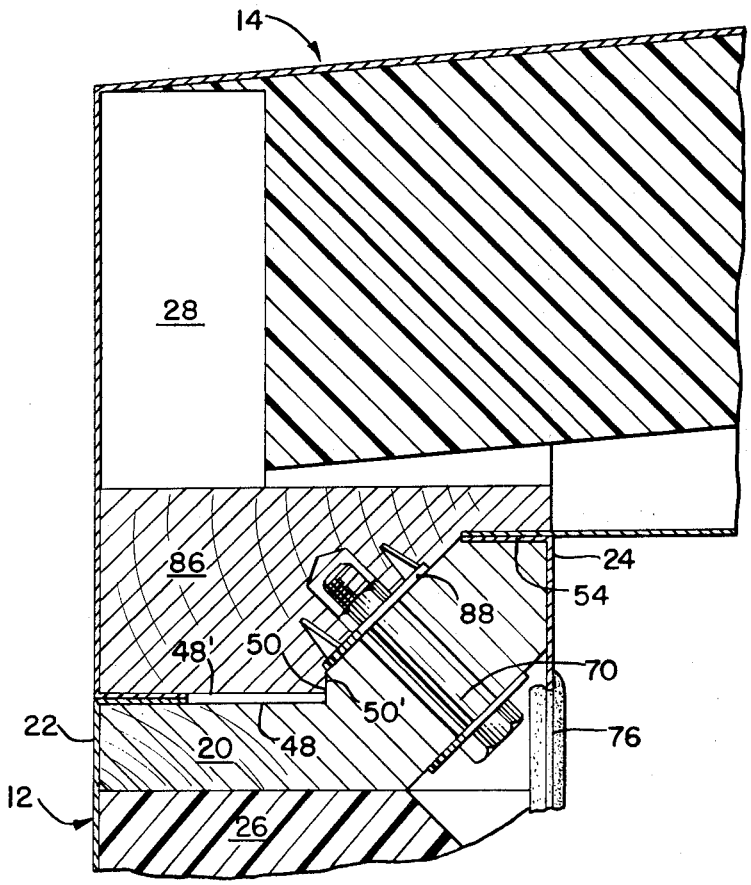
FIG. 4 is a cross-sectional view of the joint interface between the top of a wall module and a roof module.
Figure 5:
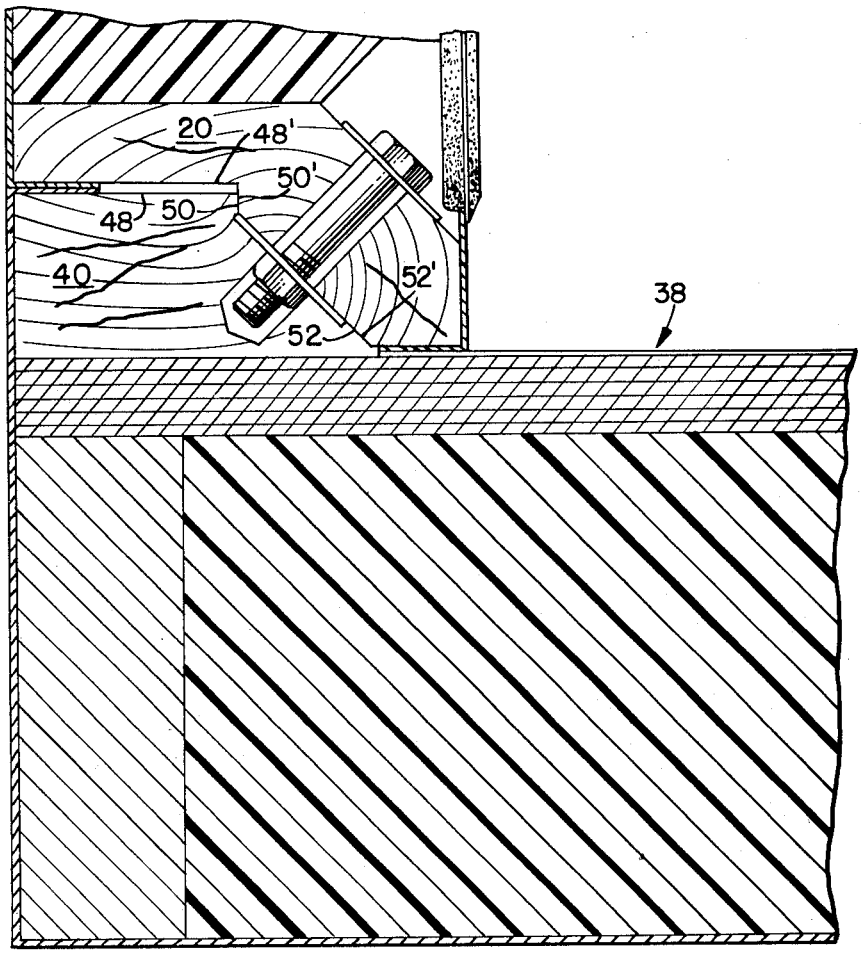
FIG. 5 is a cross-sectional view of a joint interface between the bottom of a wall module and the floor of the insulated structure.

An exemplary joint interface for connecting the top of a wall module 12 with a mating roof module 14 is shown in FIG. 4, and another exemplary joint interface for connecting the bottom of a wall module 12 with the base-floor 16 is shown in FIG. 5. In FIG. 4, the top member 20 of the wall module 12 and an interface strip 86, secured to the bottom of the truss member 28, are both provided with complementary joint surfaces 48—48', 50—50', 52—52', and 55—54' as described above. The joint interface of FIG. 4 differs from the joint interface shown in FIGS. 2 and 3 in that a threaded "nail-nut" 88 is secured in position in the interface strip 86 rather than the wood screw and washer arrangement shown in FIGS. 2 and 3. In FIG. 5, the bottom member 20 of the wall module 12 is connected to the sill member 40, secured to the top of the flooring material 38, with both the bottom member 20 of the wall module 12 and the sill member 40 both provided with the joint interfaces 48—48', 50—50', 52—52', and 54—54' substantially as described above. The joint interface, which functions in essentially the same manner as the joint interface of FIGS. 2, 3, and 4, differs in that the threaded nut/washer arrangement is retained in place using a structural adhesive (not shown). In addition to the washer/nut, the nail-nut, and adhesive arrangements described above, a wood nut, having a exterior thread adapted for threaded engagement with the wood, may be also used as the threaded fastener in the manner 18', 40, and 86.

Since the various side and top members of the wall module 12 and the sill members 40 and 86 have the same confronting surfaces, it is possible to manufacture the interface edge by milling single strips of wood and then cutting them to size for use in either the wall modules 12, roof modules 14 or as the floor sills 40.

As can be appreciated by those skilled in the art, an insulated building using the joint interfaces in accordance with the present invention can be conveniently and quickly assembled on site with the joints and the various sealing surfaces placed under a positive sealing force by the threaded fasteners used to effect mechanical connection between the various modules. Since the joints are held under a positive sealing force or pressure, the deteroriating effect of thermal stress is minimized. Of course, the individual threaded fasteners can be tightened to accomodate changes in the dimension of the wood with time.

As can be appreciated by those skilled in the art, various changes and modifications may be made to the insulated building and joint interface of the present invention without departing from the spirit and scope of the invention as recited in the appended claims and their legal equivalent.

What is claimed is:

1. A modular, air-tight insulated structure for enclosing a refrigerated area fabricated from a plurality of roof, floor, and wall modules, each of said wall modules comprising:

a structurally rigid frame means that includes spaced apart top and bottom members connected to spaced apart side members;

a first planar sheathing material on one side of said frame and a second planar sheathing material on the opposite side of said frame to define an enclosed interior space;

insulating media located within the interior space defined by said sheathing material and said frame;

each of said wall modules connected to its adjacent wall module through a joint interface that includes:

a first sealing surface joining the exterior side of said module and aligned substantially perpendicular to the plane of said module;

a second sealing surface joining said first sealing surface and aligned substantially parallel to the plane of said module;

a third sealing surface joining said second sealing surface and aligned at an oblique angle relative to the plane of said module;

a fourth sealing surface joining said third sealing surface and aligned substantially perpendicular to the plane of said module and substantially parallel to said first sealing surface;

said first and second planar sheathing material each including marginal edge portions that are bent out of the plane of the module with said edge portions substantially perpendicular to the plane of the module, the edge portions of said first sheaths overlying said first sealing surfaces and the edge portions of said second sheaths overlying said fourth sealing surfaces; and fastener means extending along an axis substantially normal to said third sealing surface to apply a direct sealing compression force to said third sealing surfaces to effect direct surface-to-surface contact therebetween, a portion of said direct sealing compression force resolved into sealing forces on the remaining parts of said first, second, and fourth sealing surfaces, the sealing forces on said first and fourth sealing surfaces placing said edges of said first and second sheaths under compression therebetween.

2. The insulated structure claimed in claim 1 wherein the rigid frame member of each of said wall modules is formed as a rectangle.

3. The insulated structure claimed in claim 2 wherein the upper, bottom, and side members of each module of each frame are fabricated from wood.

4. The insulated structure claimed in claim 1 wherein said fastener means includes a threaded fastener extending along said axis through a bore formed in a member for threaded engagement with a threaded nut secured in the member of an adjacent module.

5. The insulated structure claimed in claim 4 wherein said nut is secured to a flat washer that is secured to its associated member by wood engaging screws.

6. The insulated structure claimed in claim 4 wherein said nut is secured to a flat washer that is secured to its associated member through wood engaging prongs.

* * * * *